US012203252B2

(12) United States Patent
Pflieger

(10) Patent No.: US 12,203,252 B2
(45) Date of Patent: Jan. 21, 2025

(54) RINSING CHANNEL DEVICE FOR A BASIN

(71) Applicant: BORA—Vertriebs GmbH & Co KG, Niederndorf (AT)

(72) Inventor: Felix Pflieger, Rudersberg (DE)

(73) Assignee: BORA—Vertriebs GmbH & Co KG (AT)

( * ) Notice: Subject to any disclaimer, the term of this patent is extended or adjusted under 35 U.S.C. 154(b) by 205 days.

(21) Appl. No.: 18/015,553

(22) PCT Filed: Jul. 9, 2021

(86) PCT No.: PCT/EP2021/069166
§ 371 (c)(1),
(2) Date: Jan. 11, 2023

(87) PCT Pub. No.: WO2022/013096
PCT Pub. Date: Jan. 20, 2022

(65) Prior Publication Data

US 2023/0250619 A1 Aug. 10, 2023

(30) Foreign Application Priority Data

Jul. 13, 2020 (DE) ..... 10 2020 118 390.9

(51) Int. Cl.
*E03C 1/048* (2006.01)
*E03C 1/18* (2006.01)

(52) U.S. Cl.
CPC ..... *E03C 1/048* (2013.01); *E03C 1/18* (2013.01)

(58) Field of Classification Search
CPC ..... E03C 1/048; A61H 33/6005; A47K 3/001
See application file for complete search history.

(56) References Cited

U.S. PATENT DOCUMENTS

| | | | | |
|---|---|---|---|---|
| 2,430,297 | A | 11/1947 | Leo | |
| 5,129,590 | A | 7/1992 | Shinya | |
| 7,461,419 | B2 * | 12/2008 | Milne | E03C 1/0404 4/675 |
| 10,738,446 | B1 | 8/2020 | Munn | |
| 11,332,914 | B2 * | 5/2022 | Armbruster | E03C 1/18 |
| 11,702,828 | B2 * | 7/2023 | Song | E03C 1/186 4/638 |
| 2005/0125892 | A1 * | 6/2005 | Noh | B05B 1/169 4/675 |

(Continued)

FOREIGN PATENT DOCUMENTS

| | | |
|---|---|---|
| CN | 207314459 U | 5/2018 |
| CN | 211735626 U | 10/2020 |

(Continued)

*Primary Examiner* — Erin Deery
(74) *Attorney, Agent, or Firm* — Polsinelli PC

(57) ABSTRACT

The invention relates to a rinsing channel device for a basin, in particular for a sink or a washbasin, comprising a profile assembly having at least one interface for feeding a liquid to a distributor line of the profile assembly and having a dispensing region for dispensing the liquid. It is provided that the profile assembly comprises a flow channel extending from the distributor line to the dispensing region along a channel course. The distributor line, the flow channel and the dispensing region extend through the profile assembly along a longitudinal axis of the profile assembly.

24 Claims, 5 Drawing Sheets

(56) References Cited

U.S. PATENT DOCUMENTS

| | | | | |
|---|---|---|---|---|
| 2007/0118986 | A1* | 5/2007 | Osburn | E03C 1/0404 4/675 |
| 2007/0174958 | A1* | 8/2007 | McKay | E03C 1/182 4/619 |
| 2013/0213904 | A1 | 8/2013 | Mitchell et al. | |
| 2017/0127886 | A1 | 5/2017 | Swart | |

FOREIGN PATENT DOCUMENTS

| | | | |
|---|---|---|---|
| DE | 1934095 | U | 3/1966 |
| DE | 4204100 | A1 | 10/1993 |
| DE | 102010021541 | A1 | 11/2011 |
| DE | 202014104522 | U1 | 1/2016 |
| DE | 102021100141 | A1 | 7/2022 |
| DE | 102023200098 | A1 | 1/2024 |
| EP | 0443310 | A2 | 8/1991 |
| EP | 3295847 | A1 | 3/2018 |
| JP | S62167107 | A | 7/1987 |
| JP | H02129216 | U | 10/1990 |
| JP | 2004204543 | A | 7/2004 |
| KR | 100381215 | B1 | 4/2003 |
| KR | 20090106677 | A | 10/2009 |
| WO | 2022253930 | A1 | 12/2022 |
| WO | 2023280904 | A1 | 1/2023 |

* cited by examiner

RINSING CHANNEL DEVICE FOR A BASIN

CROSS-REFERENCE TO RELATED APPLICATION

This application claims the priority of German Patent Application, Serial No. DE 10 2020 118 390.9, filed Jul. 13, 2020, the content of which is incorporated herein by reference in its entirety as if fully set forth herein.

FIELD OF THE INVENTION

The invention relates to a rinsing channel device for a basin, in particular for a sink or a washbasin, having a profile assembly.

The invention moreover relates to a basin, in particular a sink or a washbasin, having a rinsing channel device.

BACKGROUND OF THE INVENTION

Basins in a multiplicity of embodiments are known from the prior art. In particular, sinks for use in kitchens and washbasins for body care are available in numerous variations. Such basins are used for example in households, in industry and in the medical sector.

In most cases, hygiene, in particular the sterility and cleanliness of the basins, is of central importance. Therefore, the basins should be regularly and thoroughly cleaned.

Most sinks and washbasins have a water inlet via a fitting, in order to dispense a central jet of water. A central jet of water, however, is disadvantageous for the complete and thorough cleaning of the inner sides of the basin.

To assist with cleaning, fittings with an extensible, flexible hose are known. However, they are comparatively expensive to produce and also liable to need repair. Since, moreover, the visual design of basins (in particular for household use) not uncommonly assumes high significance, flexible fittings also hinder the design freedom of the basin and of the fittings.

In order to facilitate cleaning of the basin, the generic document DE 10 2010 021 541 A1 proposes a basin in which the upper basin rim, at least in certain regions, is designed to dispense additional quantities of water. For that purpose, an inner receiving region, which has a downwardly open gap in which an encircling, annular water dispensing appliance is arranged in the manner of a pipe, is formed in the upper basin rim. On the circumferential surface, the water dispensing appliance is provided with multiple nozzles through which a quantity of water can be dispensed.

A similar basin is also disclosed in DE 1 934 095 U. DE 1 934 095 U proposes that the main feed line for the fitting of the basin runs around the upper basin rim in an annular manner and is perforated with individual holes.

In this way, the inner walls, or side walls, of the basin can be rinsed selectively. The intention is for this to reduce the complexity and frequency of manual cleaning.

However, it has been shown that the water dispensing appliances known in this respect are only conditionally suitable for cleaning the basin. Because the water is dispensed in a nozzle-like manner at certain points, a greatly uneven flow arises along the side walls of the basin. Even and thorough cleaning cannot be ensured as a result. The uneven distribution of water means that, ultimately, even additional visual contamination such as limescale can result along the side walls of the basin.

On account of the shortcomings described, basins of this type—despite a high need for hygiene and cleanliness— could not yet be sufficiently implemented until today. This is where the invention comes in.

SUMMARY OF THE INVENTION

In view of the known prior art, the object of the present invention is to provide a rinsing channel device in order to enable improved cleaning of a basin or at least to assist the cleaning of a basin.

The present invention is also based on the object of providing an improved basin, preferably a self-cleaning basin or a basin which is at least easier to clean.

The object is achieved for a rinsing channel device for a basin, in particular for a sink or a washbasin, comprising a profile assembly having at least one interface for feeding a liquid to a distributor line of the profile assembly and having a dispensing region for dispensing the liquid, wherein the profile assembly comprises a flow channel extending from the distributor line to the dispensing region along a channel course, wherein the distributor line, the flow channel and the dispensing region extend through the profile assembly along a longitudinal axis of the profile assembly. In terms of the basin, the object is achieved by a basin, in particular sink or washbasin, comprising a rinsing channel device according to the invention.

The dependent claims and the features described below relate to advantageous embodiments and variants of the invention.

What is provided is a rinsing channel device for a basin, comprising a profile assembly having an interface or having multiple interfaces for feeding a liquid to a distributor line of the profile assembly and having a dispensing region for dispensing the liquid.

The interface may in particular be a port and/or an aperture for a liquid feed line.

The proposed rinsing channel device is suitable in particular for use with sinks or washbasins. In principle, however, the rinsing channel device can be suitable for use with any desired basins for which there is a need for rinsing or cleaning. For example, the basin may also be in the form of a bathtub, shower tray, hairwashing basin or other basin, but in particular a basin for cleaning body parts, plants (plant parts) and/or objects.

The liquid may preferably be water (in particular drinking or mains water), optionally comprising additional materials or additives. In principle, any desired liquid suitable for rinsing or cleaning the basin, for example also a specially provided cleaning liquid, can be provided.

With preference, the same liquid also used for the conventional operation of the basin is fed to the rinsing channel device, optionally however comprising the additional materials or additives mentioned.

It is provided according to the invention that the profile assembly comprises a flow channel extending from the distributor line to the dispensing region along a channel course. The distributor line, the flow channel and the dispensing region extend through the profile assembly along a longitudinal axis of the profile assembly.

The inventor has recognized that liquid is dispensed from the rinsing channel device in a manner particularly suitable for cleaning the basin or for rinsing the basin when the flow channel mentioned is formed between the distributor line and the dispensing region.

By contrast to the known "self-rinsing" basins, in which water is dispensed directly from the distributor line through isolated nozzles or holes, the flow channel makes it possible to form a more even, laminar flow, as a result of which an even wetting of the inner side of the basin can be produced. In this context, it has been shown that an even distribution of liquid when the basin is being rinsed contributes essentially to the sterility and overall cleanliness of the basin.

In one refinement of the invention, it may be provided that the interface for feeding the liquid has an aperture in a side wall of the profile assembly that extends along the longitudinal axis.

The interface may for example also comprise a coupling for connection of the liquid feed line (for example a rigid or flexible pipe), a portion of the liquid feed line and/or the liquid feed line connected to the profile assembly as a whole.

In principle, any desired number of interfaces may be provided, for example exactly one interface, two interfaces, three interfaces, four interfaces or even more interfaces, which are distributed (for example evenly or equidistantly distributed) along the longitudinal axis of the profile assembly.

With preference, however, exactly one interface is provided, this facilitating the connection of the rinsing channel device to an already existing sanitary infrastructure.

The distributor line of the profile assembly may advantageously contribute to the even distribution of the liquid along the longitudinal axis of the profile assembly or within the rinsing channel device.

According to one refinement of the invention, it may be provided that the channel course is aligned orthogonally in relation to the longitudinal axis of the profile assembly.

It should be mentioned that the longitudinal axis of the profile assembly must not have a straight, or linear, course. With preference, the longitudinal axis has a curved course or at least curved portions, in particular in order to follow the course of the side walls of the basin.

The channel course also preferably does not follow a straight, or linear, course and has at least curved portions, for example the bends yet to be described below. In this way, the channel course can preferably form at least one loop (preferably multiple loops).

According to one refinement of the invention, it may be provided that the distributor line has a distributor channel diameter (or a distributor channel width) which is larger than a maximum channel diameter (or a maximum channel width) of the flow channel.

Insofar as a "diameter" is referred to in the present case, in principle it is possible that what is meant is the diameter of a round or at least approximately round channel/of a line. However, it is also possible that what is meant is the height and/or width of a channel/a line of any desired cross section, for example a rectangular cross section. The term "diameter" should thus not explicitly be understood to mean a round cross section.

As a result of the fact that the distributor region has a larger channel diameter, or a larger channel width, than the flow channel, distribution of the liquid along the longitudinal axis of the profile assembly can be improved. The distributor line can thereby receive a comparatively large quantity of liquid and can thus act as a buffer or reservoir.

In one refinement of the invention, it may be provided that the distributor line merges with the flow channel along a cross-sectional narrowing.

A uniform cross-sectional narrowing is preferably provided, in particular a linear cross-sectional narrowing. Turbulence when the liquid is being distributed can thereby substantially be prevented.

In an advantageous refinement of the invention, it may be provided that the distributor line comprises a distributor element, which is arranged in the region of the at least one interface, in order to conduct the liquid, fed through the interface, through the distributor line in at least two different directions (for example in opposite directions along the longitudinal axis of the profile assembly).

This makes it possible to distribute the liquid more evenly in the rinsing channel device. In particular, disadvantageous turbulence or swirling can be avoided, or the occurrence thereof can at least be reduced.

An individual interface can in principle also comprise multiple distributor elements. Insofar as multiple interfaces for feeding the liquid are provided, each interface can preferably be assigned at least one dedicated distributor element.

The distributor element may be arranged within the interface or fastened to the interface. However, the distributor element may also be arranged within the distributor line in a manner adjoining the interface.

According to one refinement of the invention, it may be provided in particular that the distributor element is arranged on an inner wall of the distributor line, opposite the interface in the feed direction of the liquid.

The distributor element may comprise a tip or a tapering edge aligned in the direction of the interface. The distributor element preferably has a wedge-shaped form with a linear or concavely curved wedge profile. A distributor element in the shape of a pyramid may also be provided.

In one refinement of the invention, it may be provided that the dispensing region is in the form of a dispensing slot extending along the longitudinal axis of the profile assembly.

In particular a cohesive dispensing slot extending along the longitudinal axis of the profile assembly can lead to a particularly even distribution of the liquid in the basin. If appropriate, however, it is also possible for multiple, non-cohesive dispensing regions, in particular dispensing slots, to be provided—for example one dispensing region for each side wall of the basin.

The dispensing slot preferably has a dispensing diameter, or a dispensing width, which is smaller than a minimum channel diameter/a minimum channel width of the flow channel.

Because the dispensing diameter, or the dispensing width, is smaller than the channel diameter/the channel width of the flow channel, the dispensing region forms a kind of elongate nozzle. The quantity dispensed and the flow velocity of the liquid dispensed through the dispensing region can be settable by way of the dispensing diameter, or the dispensing width.

In an advantageous refinement of the invention, it may be provided that the dispensing diameter, or the dispensing width, is approximately or exactly 0.1 mm to 2.0 mm, preferably 0.3 mm to 1.5 mm, particularly preferably 0.5 mm to 1.0 mm, for example 0.8 mm.

The regions mentioned above have proven to be particularly suitable, with it being possible for the specified dispensing diameters, or dispensing widths, preferably also to be determinable depending on the pressure used to feed the liquid (in particular with regard to the pressure within the liquid feed line). The values mentioned above are suitable in particular advantageously for use with a conventional household mains pressure of approximately 3 to 4 bar.

In one refinement of the invention, it may be provided that the dispensing region comprises an extensible diaphragm, for example a rubber lip.

The extensible diaphragm is preferably designed to close the dispensing region when no liquid is dispensed from the dispensing region.

An extensible diaphragm can optionally further improve the hygiene of the rinsing channel device, since the ingress of dirt and/or germs into the dispensing region can be avoided.

In an advantageous refinement of the invention, it may be provided that the flow channel forms at least one bend, preferably forms at least two bends, particularly preferably forms at least three bends, along the channel course. The flow channel preferably has a loop-shaped course.

Surprisingly, it has been found that in particular the use of bends, or a loop-shaped course of the flow channel, makes it possible to form a particularly suitable, even and laminar flow for rinsing the basin.

The loop-shaped course, or the bend(s), moreover makes it possible to provide a siphon-like flow channel, as a result of which at the same time an odour trap can be provided and/or the ingress of dirt or germs into the rinsing channel device can be avoided.

In an advantageous refinement of the invention, it may be provided that the flow channel has a smaller cross section along the bends.

This makes it possible to further optimize the flow behaviour of the liquid.

The cross section of the flow channel along the bends preferably corresponds to the abovementioned "minimum channel diameter", or the "minimum channel width", of the flow channel. The cross section of the flow channel along the (generally) linear, or straight, portions between the bends can then preferably correspond to the abovementioned "maximum channel diameter", or the "maximum channel width".

In an advantageous, preferred refinement of the invention, it may be provided that the distributor line, the flow channel and the dispensing region extend over the same length along the longitudinal axis of the profile assembly.

As an alternative, however, it may also be provided that the distributor line, the flow channel and the dispensing region do not extend over the same length along the longitudinal axis of the profile assembly. For example, it may be provided that the dispensing region extends only over one or over multiple subregions along the longitudinal axis of the profile assembly.

In one refinement of the invention, it may be provided that the profile assembly has a course which is intrinsically closed or at least substantially closed along the longitudinal axis.

The profile assembly preferably forms a completely closed ring, or is completely closed around its periphery. In this way, the entire periphery of the basin can be rinsed.

According to one refinement of the invention, it may be provided that the profile assembly has a one-part or multi-part form.

The decision as to whether the profile assembly has a one-part or multi-part form can be made in particular in terms of the production process, the starting material of the basin and the starting material of the rinsing channel device. Generally, a multi-part configuration of the profile assembly is preferable owing to the production process.

The profile assembly can in particular have a one-part form when the rinsing channel device is formed in one piece with the basin.

In an advantageous refinement of the invention, it may be provided that the profile assembly comprises a first profile part and a second profile part, which, when they are connected to one another, form the dispensing region, the flow channel and the distributor line (if appropriate, together with the basin).

In principle, it is also possible to provide still further profile parts, for example a third profile part, a fourth profile part or even more profile parts. A configuration of a multi-part profile assembly composed of exactly two profile parts, however, has proven to be particularly suitable for the purpose of forming an optimum between economic production and easy mounting.

It may also be provided that the basin or a constituent part of the basin, for example one or more inner walls, or side walls, of the basin form one part of the (multi-part) profile assembly. For example, the dispensing region may be formed from a profile part of the profile assembly and a side wall of the basin.

In an advantageous refinement of the invention, it may be provided that the dispensing region, the flow channel and/or the distributor line comprise ribs running between their respective side walls.

The ribs preferably run at least in certain portions along the channel course. The ribs make it possible, for the one part, to be able to define the flow of the liquid through the profile assembly and, for the other part, to improve the stability of the profile assembly, or of the rinsing channel device.

In an advantageous refinement, it may be provided that the rinsing channel device comprises at least one feeding device for feeding an additive to the liquid.

The additive may for example be a cleaning substance, for example a rinsing agent, a hygiene product, a disinfectant and/or a descaler. This makes it possible to functionally improve the rinsing of the basin by the rinsing channel device—for example in order to improve the cleaning action of the rinsing.

According to one refinement of the invention, it may be provided that the feeding device comprises a reservoir for providing the additive.

The reservoir can preferably be manually fillable or be supplied from a supply line.

In an advantageous refinement of the invention, it may be provided that the feeding device comprises a conveying device for conveying and metering the additive, in particular a pump and/or a Venturi nozzle.

The pump may be an electric pump and/or a mechanical pump, for example a foot-operated pump.

The feeding device may moreover comprise electrical and/or mechanical valves, in order to meter the additive in accordance with requirements or to interrupt the feed in accordance with requirements.

The pump, the valves and, if appropriate, the Venturi nozzle can be actuated mechanically and/or electronically. Optionally, automated open-loop or closed-loop control can be provided. However, purely manual operation is also possible.

It may also be provided that the rinsing channel device comprises a conveying unit for conveying and/or metering the liquid, in particular a pump. The liquid may be feedable to the rinsing channel device from a reservoir, or a liquid store, together with the liquid for the purpose of conventional use of the basin or separately therefrom.

Insofar as the reservoir for the additive or the reservoir, or the liquid store, for the liquid is arranged at a higher level, it is optionally possible to dispense with a respective pump.

In an advantageous refinement of the invention, it may be provided that the rinsing channel device is in the form of a constituent part of the basin or an insert for the basin.

According to one refinement of the invention, it may moreover be provided that the profile assembly is provided with an antimicrobial coating in certain regions or completely, preferably affecting the interface, the dispensing region and/or the flow channel. The antimicrobial coating may for example be a nanosilver coating.

In this way, the formation of biofilm can be prevented and sterility can be ensured, even when the rinsing channel device or the basin is not used for a relatively lengthy period of time.

In one refinement of the invention, it may be provided that the rinsing channel device comprises a control device configured to control and/or monitor the dispensing of the liquid from the dispensing region, preferably depending on a user input.

The control device may be communicatively connected (in wired and/or wireless fashion) to electronic components of the rinsing channel device, such as pumps, other actuators, sensors, the radiation source yet to be described below, the discharging device yet to be described below, or other devices.

The control device may comprise a user interface in order to enable a user input from the user of the rinsing channel device or of the basin and/or to make it possible to read out states and measurement values. The user interface may comprise a display device, for example a screen and/or an input device, for example one or more pushbuttons. A wireless user interface is preferably provided, with it being possible to use any desired radio standard, in particular a Bluetooth standard, a WLAN standard, a Zigbee standard, a GSM standard or another radio standard, but in particular within the ISM band. The user interface may comprise a web application and/or an application on a mobile terminal ("app").

The control device may comprise a data interface, via which the control device is connected to a database and optionally an external computer unit. In particular, the data interface can provide an Internet connection, as a result of which the control device can be connected to a cloud system, for example.

The control device may be configured to plan and manage cleaning cycles, preferably in accordance with automatable schedules relating to the start, end, duration and/or intensity of a cleaning cycle. It is also possible to provide monitoring of fill levels, etc.

In one refinement, it may be provided that the rinsing channel device comprises a generator arrangement for partially converting kinetic energy of the fed liquid (cleaning liquid and/or liquid used for the conventional operation of the basin) to electrical energy, for the purpose of preferably self-sufficiently supplying electrical power to electronic components of the rinsing channel device. In this way, it is possible to control the rinsing channel device even without access to an electrical connection.

The generator arrangement may in particular comprise a water turbine and a generator connected to the water turbine.

Optionally, an electrical energy store, such as a rechargeable battery pack, may be provided, in order to store the electrical energy generated by means of the generator arrangement. An electrical energy store, in particular an exchangeable or rechargeable energy store, may also be provided as a comprehensive alternative to a generator arrangement. In this way, the rinsing channel device may be operated autonomously at least for some time.

The generator arrangement may preferably be arranged directly upstream of, downstream of or in the interface of the profile assembly. An arrangement in a feed line to the interface or in the distributor line may also be provided, however. It may also be provided to connect the generator arrangement to any desired liquid feed line of the basin—if appropriate, also to the liquid feed line to a conventional fitting of the basin (that is to say, for example, to an angle valve on the building). The generator arrangement may in particular comprise a ⅜ inch coupling for the purpose of connection to the liquid feed line.

The invention also relates to a basin, in particular a sink or a washbasin, comprising a rinsing channel device according to the statements made above and below.

Advantageously, a self-cleaning recirculating rinsing channel basin may be provided. Dirt, food residues, germs and the like that fall into the basin according to the invention can easily be washed away, or removed, by the rinsing channel device, since they generally cannot build up on the side walls. Accordingly, should dirt adhere to the side walls of the basin once, it can subsequently be easily removed. The basin can thus be self-cleaning, or at least support manual cleaning.

According to the invention, hygiene when the basin is being operated can be significantly improved, for example in hospitals, nursing homes, medical practices, laboratories, in private households and also extensively in the foodstuff industry. The infection and contamination potential, for example of sinks or washbasins, can be considerably reduced according to the invention.

It may be provided that the rinsing channel device is adhesively bonded, screwed or otherwise detachably or non-detachably connected to the basin. As already mentioned above, it is also possible to provide that the rinsing channel device and the basin are one part.

The rinsing channel device for rinsing the basin can be activated mechanically and/or electronically.

A rinsing interval or multiple rinsing intervals for rinsing the basin using the rinsing channel device can preferably be freely selectable and definable for example by means of a timing circuit.

To actuate the rinsing channel device, in particular the control device described above may be provided, for example for the purpose of controlling valves, pumps, electromechanical nozzles and/or to evaluate sensors and actuation switches.

The control device may be in the form of a microprocessor. Instead of a microprocessor, it is also possible to provide any desired further device to implement the control device, for example one or more arrangements of discrete electrical components on a printed circuit board, a stored-program controller (SPC), an application-specific integrated circuit (ASIC) or another programmable circuit, for example also a field programmable gate array (FPGA), a programmable logic array (PLA) and/or a commercially available computer.

The basin may be made from a metal, in particular a metal sheet, a ceramic and/or a plastics material. The basin can preferably also be made from a composite material, for example a quartz composite material. A combination of various materials is also possible, of course. In principle, the basin may be made from any desired material.

The rinsing channel device, in particular the profile assembly of the rinsing channel device, can preferably be made from a plastics material. In principle, however, the rinsing channel device, or the profile assembly, may be made from any desired material, for example even from a metal. A combination of various materials may also be provided, of course.

In an advantageous refinement of the invention, it may be provided that the dispensing region of the rinsing channel device is designed to rinse at least one side wall of the basin, preferably two side walls of the basin, further preferably three side walls of the basin and very particularly preferably four side walls or all side walls of the basin, with the liquid dispensed from the dispensing region.

The rinsing channel device is particularly preferably arranged in the basin in such a way that the rinsing channel device can rinse the basin all the way around the inside.

In principle, the basin may comprise any desired optional components, in particular a liquid outlet for the liquid (outflow, downpipe and/or siphon), an overflow for the liquid, deposition surfaces etc.

In one refinement, it may in particular be provided that the basin comprises a fitting supplied (in particular with drinking or mains water) by a main feed line.

The main feed line is preferably fluidically connected to the liquid feed line and/or the interface of the rinsing channel device, in order to feed the same liquid to the basin via the fitting and via the dispensing region of the rinsing channel device.

It is preferably possible for the feed of liquid by way of the rinsing channel device together with the liquid feed line to be adjustable by the fitting, in order to enable for example simultaneous, or synchronous, dispensing of liquid from the fitting and the rinsing channel device. The fluidic connection between the main feed line and the liquid feed line may for example be arranged downstream of a valve of the fitting in the flow direction, in order to adjust the dispensing of liquid from the rinsing channel device via the valve of the fitting.

However, the fluidic connection between the main feed line and the liquid feed line is preferably arranged upstream of the valve of the fitting in the flow direction, thereby making it easier to integrate the rinsing channel device in an existing basin, or to use the rinsing channel device with conventional fittings. In this case, the rinsing channel device may, if appropriate, comprise a separate (electrical and/or mechanical) valve.

The rinsing operation using the rinsing channel device may optionally be actuated automatically and/or manually, depending on the contamination.

It may also be provided that the fitting and/or the rinsing channel device are/is actuated by means of a proximity and/or motion sensor.

According to one refinement of the invention, it may be provided that the basin or the rinsing channel device comprises at least one radiation source for generating ionizing radiation. A UVC radiation source for generating UVC radiation is preferably provided.

The ionizing radiation makes it possible to further enhance the cleaning or disinfecting action of the basin according to the invention, or the rinsing channel device according to the invention. The wavelength of the ultraviolet radiation may be for example 100 nm to 400 nm, preferably 200 nm to 300 nm, particularly preferably approximately or exactly 254 nm.

In one refinement, the radiation source may be arranged in particular within a liquid outlet of the basin and/or within the profile assembly. It is also possible to provide multiple radiation sources.

The radiation sources, in particular the UVC radiation source, are preferably optically shielded, for example arranged behind a cover of the liquid outlet.

In one refinement of the invention, it is moreover possible to provide a discharging device for filtering and discharging solids (for example contamination like hair or some other organic material, but also inorganic material) from the liquid.

The discharging device is preferably arranged close to the bottom, that is to say in the lower region, of the basin or—particularly preferably—in a liquid outlet of the basin.

Consequently, solids that accumulate when the basin is being used can be filtered out before they enter the wastewater pipe system, this preventing blockage of the wastewater pipes. The formation of germs and troublesome development of odours in the wastewater pipes can also be prevented.

In one refinement, it may be provided that the discharging device comprises a sheet-like filter component (such as a strip, a mat, a textile or a film) through which the liquid can flow away, whereas the solids remain on the surface of the sheet-like filter component.

The surface of the filter component can ultimately be (manually and/or automatically) cleaned to remove the solids in accordance with requirements or regularly, for example by transferring the solids to a collection container, or by exchanging the filter component.

In a preferred refinement, the sheet-like filter component is mounted on a circulating roller conveyor and can be moved in circulation by driving at least one roller of the roller conveyor, in order to discharge filtered-out solids in accordance with demand, for example to transfer them into the abovementioned collection container.

At this juncture, it should be mentioned that the present description also comprises the following inventions independent of the patent claims, the applicant reserving the right to claim the mentioned inventions separately.

According to a first separate invention, a basin, in particular a sink or washbasin, comprising a generator arrangement for partially converting kinetic energy of a liquid fed to the basin to electrical energy, is provided. The generator arrangement is preferably arranged on a feed line to a fitting of the basin. The features of the generator arrangement described in the context of the rinsing channel device for a basin, in particular for a sink or a washbasin, comprising a profile assembly having at least one interface for feeding a liquid to a distributor line of the profile assembly and having a dispensing region for dispensing the liquid, wherein the profile assembly comprises a flow channel extending from the distributor line to the dispensing region along a channel course, wherein the distributor line, the flow channel and the dispensing region extend through the profile assembly along a longitudinal axis of the profile assembly, and all further features of this description form advantageous refinements of the first separate invention.

According to a second separate invention, a basin, in particular a sink or washbasin, comprising at least one radiation source for generating ionizing radiation, preferably UVC radiation, is provided. The radiation source is preferably arranged within a liquid outlet of the basin. The features of the radiation source described in the context of the basin, in particular sink or washbasin, comprising a rinsing channel device according to the invention, and all further features of this description form advantageous refinements of the second separate invention.

According to a third separate invention, a basin, in particular a sink or washbasin, comprising at least one discharging device for filtering and discharging solids from a liquid flowing out of the basin is provided, with the discharging device being arranged close to the bottom within the basin or in a liquid outlet of the basin. The discharging device preferably comprises a sheet-like filter component through which the liquid can flow away, whereas solids remain on the surface of the filter component. The sheet-like filter component is preferably mounted on a circulating roller conveyor and can be moved in circulation by driving at least one roller of the roller conveyor, in order to discharge filtered-out solids in accordance with demand. The features of the discharging device described in the context of the basin, in particular sink or washbasin, comprising a rinsing channel device according to the invention, and all further features of this description form advantageous refinements of the third separate invention.

Features that have been described in connection with one of the subjects of the invention, specifically in particular provided by the rinsing channel device and the basin, can also be advantageously implemented for the other subjects of the invention and the first, the second and the third independent invention. Similarly, advantages that were mentioned in connection with one of the subjects of the invention can also be understood as relating to the other subjects of the invention and to the first, the second and the third independent invention.

In addition, it should be noted that terms such as "comprising", "having" or "with" do not exclude any other features or steps. Furthermore, terms such as "a", "an" or "the" that refer to a single number of steps or features do not exclude a plurality of features or steps, and vice versa.

In a puristic embodiment of the invention, however, it may also be provided that the features introduced in the invention by the terms "comprising", "having" or "with" constitute an exhaustive list. Accordingly, within the context of the invention, one or more lists of features may be considered as self-contained, for example respectively for each claim. The invention may, for example, consist exclusively of the features mentioned in claim 1.

It should be noted that designations such as "first" or "second" etc. are used primarily for the purposes of being able to make a distinction between respective device or method features and are not necessarily intended to indicate that features require one another or are related to one another.

It should also be emphasized that the values and parameters described in the present document include deviations or fluctuations of ±10% or less, preferably ±5% or less, further preferably ±1% or less, and very particularly preferably ±0.1% or less in the respectively mentioned value or parameter, provided that these deviations are not ruled out when implementing the invention in practice. The specification of ranges by way of start and end values also comprises all those values and fractions that are included by the respectively mentioned range, in particular the start and end values and a respective mean value.

Exemplary embodiments of the invention will be described in more detail below on the basis of the drawing.

The figures each show preferred exemplary embodiments in which individual features of the present invention are illustrated in combination. Features of one exemplary embodiment can also be implemented in isolation from the other features of the same exemplary embodiment and can accordingly be readily combined with features of other exemplary embodiments by a person skilled in the art to form further expedient combinations and sub-combinations.

Elements that have the same function are provided with the same reference signs in the figures.

DETAILED DESCRIPTION

Figure 1:
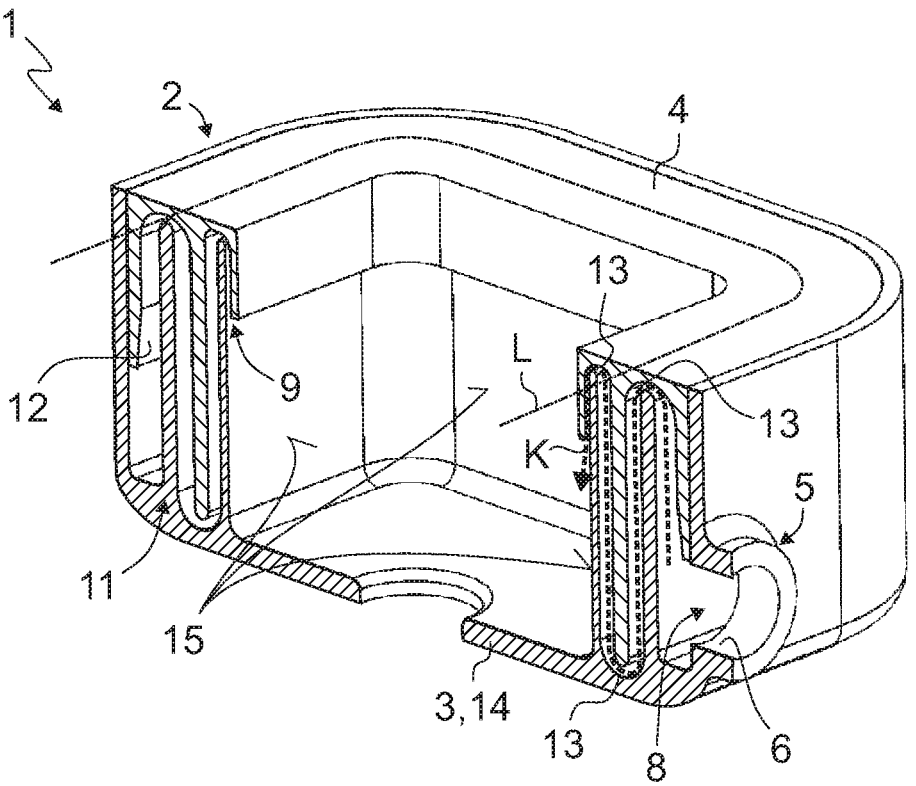
FIG. 1 shows a perspective sectional illustration of a two-part rinsing channel device according to a first exemplary embodiment of the invention.

FIGS. 1 to 4 show a rinsing channel device 1 according to a first exemplary embodiment of the invention. The geometric dimensions and relationships should be understood as being merely exemplary in the drawings, in order to illustrate the functional principle of the invention.

The rinsing channel device 1 comprises a profile assembly 2, which has a multi-part form in the exemplary embodiment shown in FIGS. 1 to 4, but in principle may also have a one-part form. As can be seen particularly well in FIG. 3, the profile assembly 2, which should be understood as only exemplary, comprises a first profile part 3 and a second profile part 4. This makes it possible to simplify the production of the rinsing channel device 1.

The profile assembly 2 has at least one interface 5 for feeding a liquid (preferably water, or mains water). The interface 5 has a recess 6 in a side wall of the profile assembly 2 that extends along the longitudinal axis L of the rinsing channel device 1. A liquid feed line 7 (cf. FIG. 5) may be connectable to the interface 5.

The liquid can be introduced into a distributor line 8 of the profile assembly 2 via the interface 5. The distributor line 8 extends completely through the profile assembly 2 along the longitudinal axis L of the profile assembly 2 in order to distribute the liquid around the periphery of the rinsing channel device 1.

In principle, it is also possible to provide still further interfaces 5 for feeding the liquid, for example an interface 5 on each side of the profile assembly 2. However, preferably only a single interface 5 is provided.

The profile assembly 2 also has a dispensing region 9 for dispensing the liquid. The dispensing region 9 also extends completely through the profile assembly 2 along the longitudinal axis L of the profile assembly 2. The dispensing region 9 is in the form of a dispensing slot extending along the longitudinal axis L of the profile assembly 2. The dispensing region 9 map optionally comprise an extensible diaphragm 10, for example a rubber lip (illustrated in dashed lines in FIG. 2), which is preferably designed to close the dispensing region 9 when no liquid is dispensed from the dispensing region 9. This makes it possible to improve the sterility of the rinsing channel device 1.

Figure 2:
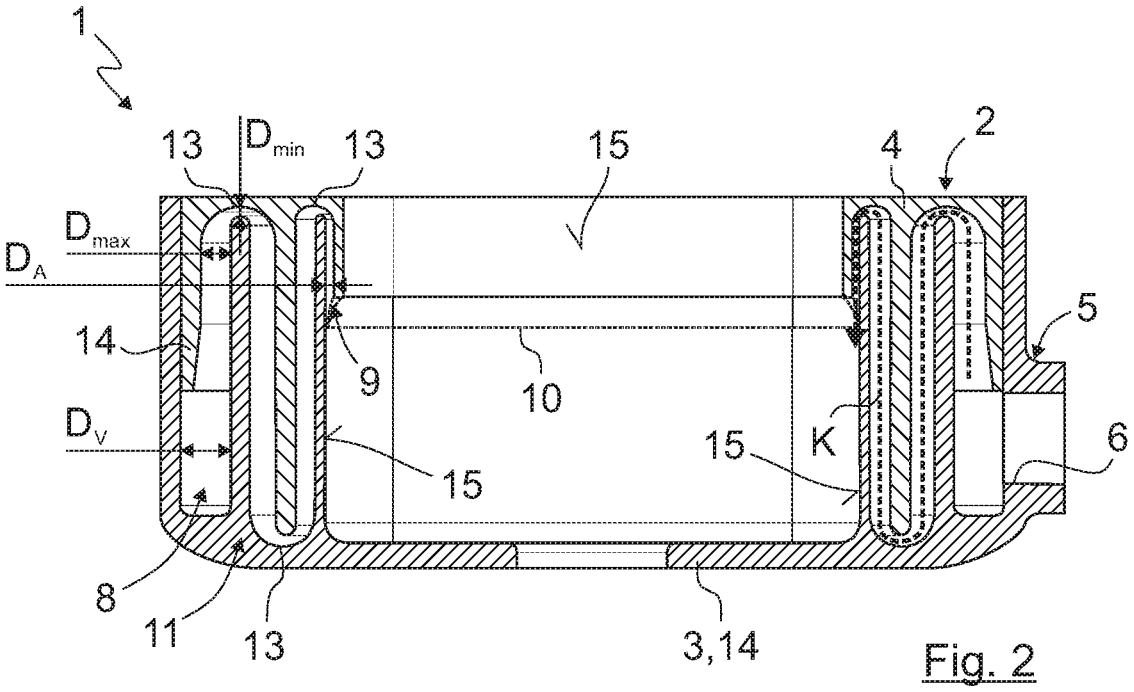
FIG. 2 shows a sectional illustration from the side of the rinsing channel device of FIG. 1.
Figure 3:
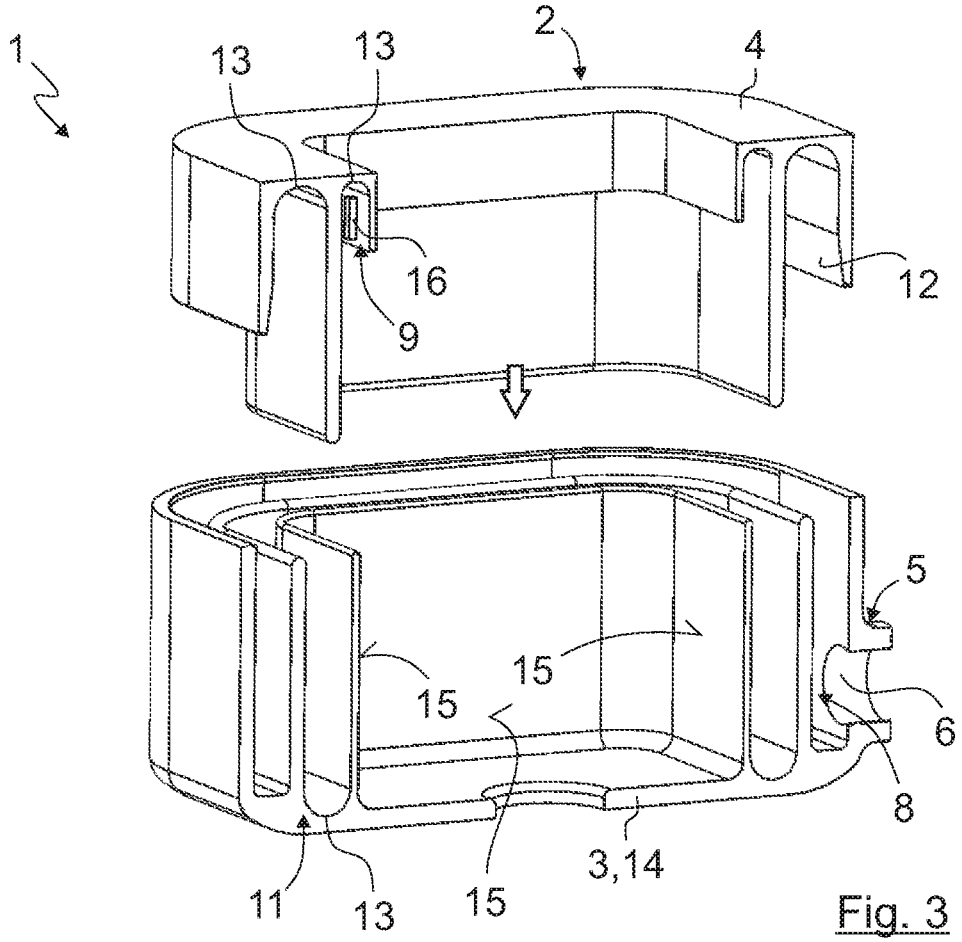
FIG. 3 shows a perspective sectional illustration of the rinsing channel device of FIG. 1 in the unmounted state.

It is provided that the profile assembly 2 comprises a flow channel 11 extending from the distributor line 8 to the dispensing region 9 along a channel course K (cf. FIGS. 1 and 2). The flow channel 11 also extends through the profile assembly 2 along the longitudinal axis L of the profile assembly 2. In this respect, the channel course K is aligned orthogonally in relation to the longitudinal axis L of the profile assembly 2 (cf. in particular FIG. 1).

The flow channel 11 makes it possible to make the flow of the liquid dispensed from the dispensing region 9 particularly even and laminar, thereby improving the cleaning action of the rinsing channel device 1 according to the invention.

The distributor line 8, the flow channel 11 and the dispensing region 9 preferably extend over the same length along the longitudinal axis L of the profile assembly 2.

It may be provided that the distributor line 8 has a distributor channel diameter (or a distributor channel width) $D_V$ which is larger than a maximum channel diameter (or a maximum channel width) $D_{max}$ of the flow channel 11 (cf. FIG. 2). The distributor line 8 may merge with the flow channel 11 in particular along a cross-sectional narrowing 12.

It may moreover be provided that the dispensing region 9, or the dispensing slot, has a dispensing diameter (or a dispensing width) $D_A$ which is smaller than a minimum channel diameter (a minimum channel width) $D_{min}$ of the flow channel 11. The dispensing diameter, or the dispensing width, $D_A$ may for example be approximately or exactly 0.1 mm to 2.0 mm, in particular approximately or exactly 0.8 mm.

As can be seen particularly well in FIGS. 1 and 2, the flow channel 11 forms multiple bends 13 along the channel course K. In the exemplary embodiments, exactly three bends 13 are provided. Optionally, the flow channel 11 has a smaller cross section along the bends 13, in particular according to the minimum channel diameter, or the minimum channel width, $D_{min}$. The loops formed by the flow channel 11 make it possible to influence the flow of the liquid particularly well and moreover also to rule out a backflow and thus a carryover of germs into the rinsing channel device 1.

Figure 6:
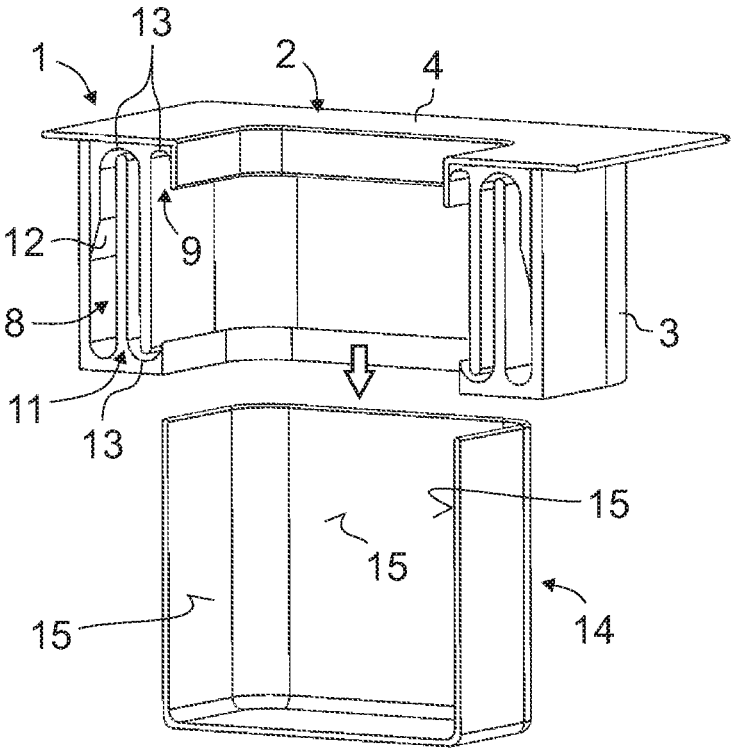
FIG. 6 shows a perspective sectional illustration of a two-part rinsing channel device according to a second exemplary embodiment of the invention while it is being mounted in a basin.

The rinsing channel device 1 may be in the form of a constituent part of a basin 14 (cf. FIGS. 1 to 4 and 7) or an insert for a basin 14 (cf. FIG. 6). In the exemplary embodiment shown in FIGS. 1 to 4, the first profile part 3 is formed in one part with the basin 14. The basin 14 and the second profile part 4 thus together form the profile assembly 2. In the case of the second exemplary embodiment yet to be described below, a two-part rinsing channel device 1 can be inserted into an existing basin 14, with the last loop of the flow channel 11 and the dispensing region 9, or the dispensing slot, being formed between the first profile part 3 and the basin 14.

Figure 4:
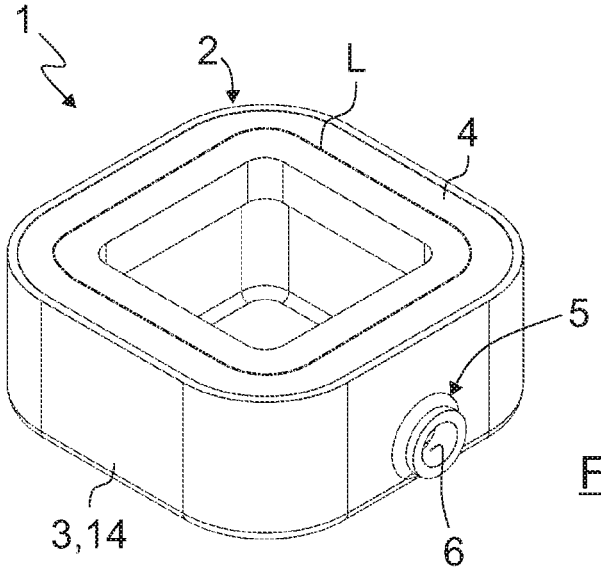
FIG. 4 shows a perspective illustration of the rinsing channel device of FIG. 1.

In the exemplary embodiments, the profile assembly 2 has an annular course which is intrinsically closed along its longitudinal axis L (cf. in particular FIG. 4). In principle, however, the profile assembly 2 does not have to be completely intrinsically closed and may, for example, also merely cover a single side wall 15 or part of the side walls 15 of the basin 14.

Optionally, it may be provided that the dispensing region 9, the flow channel 11 and/or the distributor line 8 comprise ribs 16 running between their respective side walls. Purely by way of example, a single rib 16 is illustrated adjoining the dispensing region 9 in FIG. 3. The ribs 16 make it possible to improve the stability of the profile assembly 2 and moreover to be able to optimize the course of the flow.

It may be provided that the rinsing channel device 1 comprises at least one feeding device 17 for feeding an additive 18 to the liquid. An exemplary feeding device 17 is illustrated schematically in FIG. 5. The additive 18 may for example be a cleaning substance, a disinfectant, a descaler or the like. The feeding device 17 may comprise a reservoir 19 for providing the additive 18. To convey and/or meter the additive, the feeding device 17 may comprise a pump, for example an electronically actuatable pump 20 that is illustrated, mechanically/electronically actuatable valves and/or a Venturi nozzle.

The rinsing channel device 1 may comprise a control device 21 configured to control and/or monitor the dispensing of the liquid from the dispensing region 9, preferably depending on a user input. The control device 21 is indicated in dashed lines in FIG. 5 and is illustrated communicatively connected, by way of example, to the pump 20 for the purpose of actuating said control device.

Figure 5:
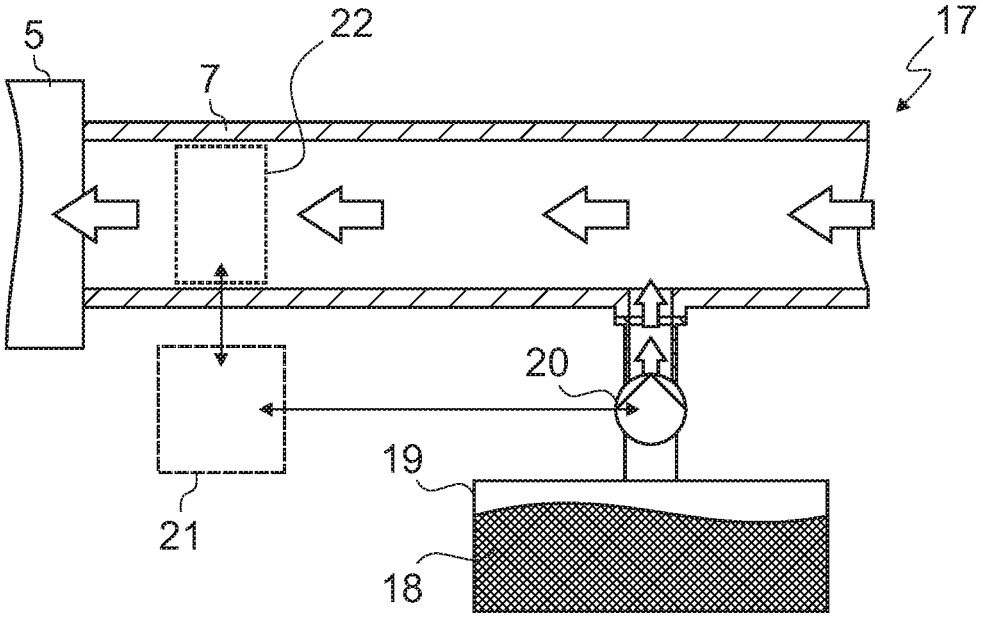
FIG. 5 shows a feeding device, for a rinsing channel device according to the invention, for feeding an additive to the liquid.

To preferably self-sufficiently supply electrical power to the rinsing channel device 1, for example the control device 21, the pump 20 etc., a generator arrangement 22, indicated likewise by dashed lines in the liquid feed line 7 in FIG. 5, may be provided. The optional generator arrangement 22 may in principle be provided at any desired location, though which a liquid flows, within the rinsing channel device 1 or the basin 14.

FIG. 6, which has already been mentioned, illustrates a two-part rinsing channel device 1 according to a second exemplary embodiment of the invention. The rinsing channel device 1 is in the form of an insert for the basin 14 (preferably a metal basin), which is shown only schematically, and can be inserted therein. The dispensing region 9 is formed between the profile assembly 2 of the rinsing channel device 1 and the respective side wall 15 of the basin 14. This is intended to illustrate that the basin 14 can also act as a functional constituent part of the profile assembly 2 when the rinsing channel device 1 is formed fundamentally independently of the basin 14.

Figure 7:
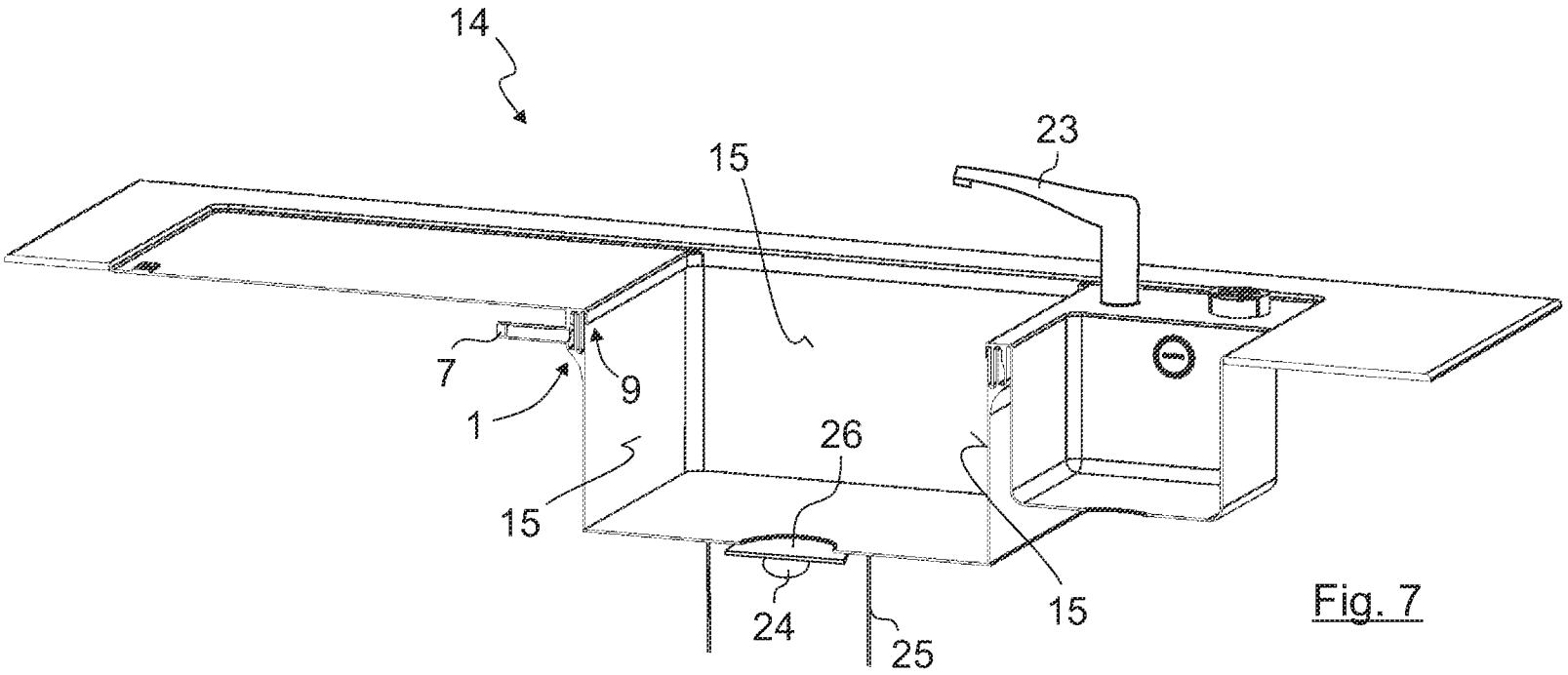
FIG. 7 shows a basin according to the invention with an integrated rinsing channel device.

Lastly, FIG. 7 illustrates a basin 14 (by way of example a sink), in which a rinsing channel device 1 according to the invention is fully integrated. The basin 14 comprises various known constituent parts of a basin 14 and in this respect in particular a fitting 23, which is supplied by a main feed line, which is not illustrated in more detail. The main feed line is preferably fluidically connected to the liquid feed line 7, or to the interface 5 of the rinsing channel device 1, in order to feed the same liquid, preferably drinking or mains water, to the basin 14 via the fitting 23 and via the dispensing region 9 of the rinsing channel device 1.

The dispensing region 9 of the rinsing channel device 1 is preferably designed to rinse all inner walls, or side walls 15, of the basin 14 with the liquid dispensed from the dispensing region 9. In principle, however, it may also be provided that the rinsing channel device 1 rinses only part of the side walls 15 of the basin 14 or even only a portion of individual side walls 15 of the basin 14.

As indicated by way of example in FIG. 7, it is possible to provide a radiation source 24, in order to generate ionizing radiation and to disinfect the liquid before and/or after it flows through the basin 14 or components of the basin 14. In this respect, at least one radiation source (in particular a UVC radiation source for generating UVC radiation) is preferably arranged within a fluid outlet 25 of the basin 14. The ionizing radiation may be optically shielded by a protective metal sheet 26, for example.

It should be mentioned that, in principle, it is also possible for multiple rinsing channel devices 1 to be distributed within a common basin 14.

Figure 8:
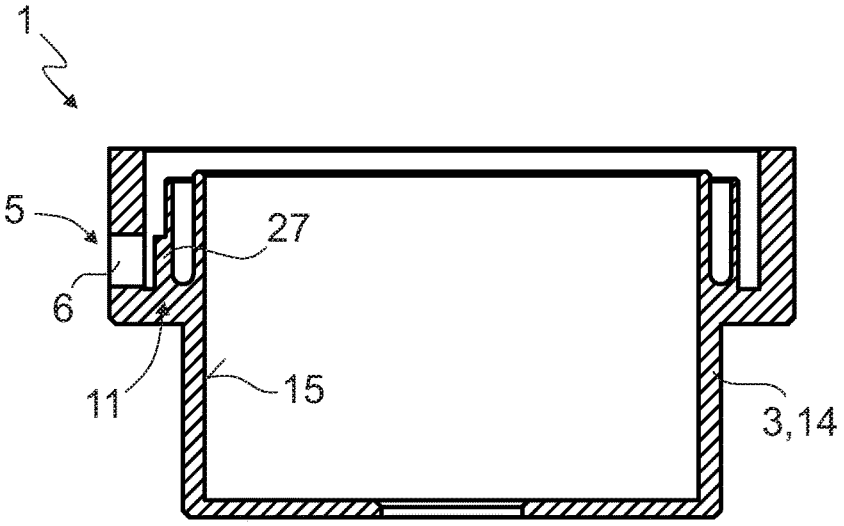
FIG. 8 shows a sectional illustration from the side of the first profile part of a further rinsing channel device with a distributor element arranged in the region of the interface for the purpose of feeding the liquid.
Figure 9:
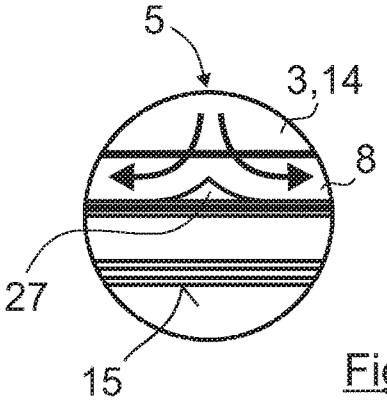
FIG. 9 shows an illustration, in a plan view, of the distributor element of the rinsing channel device of FIG. 8.

To illustrate a further refinement, which can be combined with all exemplary embodiments, FIG. 8 shows a sectional illustration, from the side, of the first profile part 3 of a further rinsing channel device 1 with a distributor element 27 arranged in the region of the interface 5 for feeding the liquid. FIG. 9 shows an illustration, in a plan view, of the distributor element 27 of the rinsing channel device 1. The distributor element 27 is arranged in the distributor line 8 in the region of the interface 5, in order to conduct the liquid, fed through the interface 5, through the distributor line 8 in at least two different directions (cf. arrows in FIG. 9). To that end, the distributor element 27 is arranged on an inner wall of the distributor line 8, opposite the interface 5 in the feed direction of the liquid, and is aligned in the direction of the interface 5 by way of a tapering edge. In the exemplary embodiment, the distributor element 27 has a wedge-shaped form with a concavely curved profile of the side faces (cf. FIG. 9).

Figure 10:
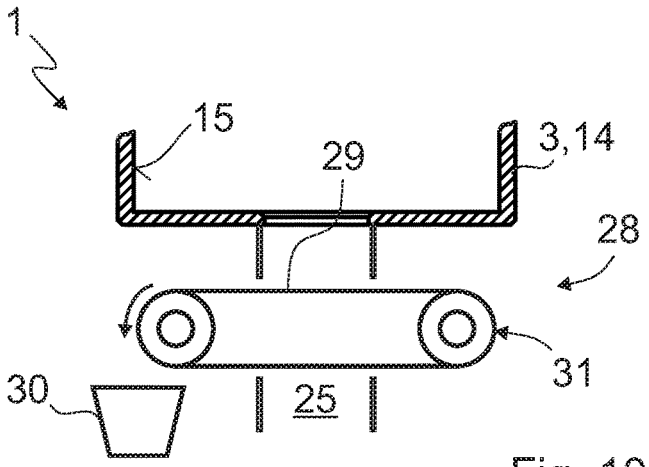
FIG. 10 shows a discharging device for filtering and discharging solids from the liquid in the liquid outlet of the basin.

A further advantageous configuration of the invention with a discharging device 28 for filtering and discharging solids from the liquid is lastly also shown in FIG. 10. The discharging device 28 is arranged in the liquid outlet 25 of the basin 14 and can therefore filter out solids that accumulate when the basin 14 is being used before they enter the wastewater pipe system, this preventing blockage of the wastewater pipes, formation of germs and troublesome development of odours in the wastewater pipes. The discharging device 28 comprises a sheet-like filter component 29 through which the liquid can flow away, whereas the solids remain on the surface of the filter component. The surface of the filter component 29 can ultimately be (manually and/or automatically) cleaned to remove the solids in accordance with requirements or regularly, for example by transferring the solids to a collection container 30. In the exemplary embodiment, to that end the filter component 29 is mounted on a circulating roller conveyor 31 and can be moved in circulation by driving at least one roller of the roller conveyor 31, as a result of which the filtered-out solids can be transferred to the collection container 30.

The invention claimed is:

1. A rinsing channel device (1) for a basin, (14), the basin being for a sink or a washbasin, comprising a profile assembly (2)

having at least one interface (5) for feeding a liquid to a distributor line (8) of the profile assembly (2) and having a dispensing region (9) for dispensing the liquid, wherein the profile assembly (2) comprises a flow channel (11) extending from the distributor line (8) to the dispensing region (9) along a channel course (K), wherein the distributor line (8) has a distributor channel diameter ($D_V$) which is larger than a maximum channel diameter ($D_{max}$) of the flow channel (11), wherein the dispensing region is a dispensing slot (9) extending along a longitudinal axis (L) of the profile assembly (2), wherein the dispensing slot (9) has a dispensing diameter ($D_A$) which is smaller than a minimum channel diameter ($D_{min}$) of the flow channel (11) and wherein the flow channel (11) forms at least one bend (13) along the channel course (K).

2. The rinsing channel device (1) according to claim 1, wherein the distributor line (8), the flow channel (11) and the dispensing region (9) extend through the profile assembly (2) along a longitudinal axis (L) of the profile assembly (2) and wherein the channel course (K) is aligned orthogonally in relation to the longitudinal axis (L) of the profile assembly (2).

3. The rinsing channel device (1) according to claim 1, wherein the distributor line (8) merges with the flow channel (11) along a cross-sectional narrowing (12).

4. The rinsing channel device (1) according to claim 1, wherein the distributor line (8) comprises a distributor element (27), which is arranged in a region of the at least one interface (5), in order to conduct the liquid, fed through the interface (5), through the distributor line (8) in at least two different directions.

5. The rinsing channel device (1) according to claim 4, wherein the distributor element (27) is arranged on an inner wall of the distributor line (8), opposite the interface (5) in the feed direction of the liquid, and is aligned in the direction of the interface (5) by way of a tip or tapering edge.

6. The rinsing channel device (1) according to claim 1, wherein the dispensing diameter (DA) is in the range of 0.1 mm to 2.0 mm.

7. The rinsing channel device (1) according to claim 1, wherein the dispensing region (9) comprises an extensible diaphragm (10) which is designed to close the dispensing region (9) when no liquid is dispensed from the dispensing region (9).

8. The rinsing channel device (1) according to claim 1, wherein the at least one bend is two bends (13) along the channel course (K).

9. The rinsing channel device (1) according to claim 1, wherein the profile assembly (2) has a course which is closed or at least substantially closed along the longitudinal axis (L).

10. The rinsing channel device (1) according to claim 1, wherein the profile assembly (2) comprises a first profile part (3) and a second profile part (4), which, when they are connected to one another, form the dispensing region (9), the flow channel (11) and the distributor line (8).

11. The rinsing channel device (1) according to claim 1, wherein the dispensing region (9), the flow channel (11) and/or the distributor line (8) comprise ribs (16) running between their respective side walls.

12. The rinsing channel device (1) according to claim 1, comprising at least one feeding device (17) for feeding an additive (18) to the liquid.

13. The rinsing channel device (1) according to claim 12, wherein the at least one feeding device (17) comprises a reservoir (19) for providing the additive (18) and wherein the at least one feeding device (17) comprises a conveying device for conveying and metering the additive (18), the conveying device being a pump (20) and/or a Venturi nozzle.

14. The rinsing channel device (1) according to claim 1, wherein the rinsing channel device (1) is a constituent part of the basin (14) or an insert for the basin (14).

15. The rinsing channel device (1) according to claim 1, wherein the profile assembly (2) is provided with an antimicrobial coating in regions affecting the interface (5), the dispensing region (9) and/or the flow channel (11).

16. The rinsing channel device (1) according to claim 1, comprising a control device (21) configured to control and/or monitor the dispensing of the liquid from the dispensing region (9), depending on a user input.

17. The rinsing channel device (1) according to claim 1, comprising a generator arrangement (22) for partially converting kinetic energy of the fed liquid to electrical energy, for supplying electrical power to electronic components of the rinsing channel device (1).

18. A basin (14) comprising the rinsing channel device (1) according to claim 1.

19. The basin (14) according to claim 18, wherein the dispensing region (9) of the rinsing channel device (1) is designed to rinse at least one side wall (15) of the basin (14) with the liquid dispensed from the dispensing region (9).

20. The basin (14) according to claim 18, comprising a fitting (23) supplied by a main feed line, wherein the main feed line is fluidically connected to a liquid feed line (7) of the rinsing channel device (1), in order to feed the same liquid to the basin (14) via the fitting (23) and via the dispensing region (9) of the rinsing channel device (1).

21. The basin (14) according to claim 18, comprising a UVC radiation source (24) for generating UVC radiation.

22. The basin (14) according to claim 21, wherein the UVC radiation source (24) is arranged within a liquid outlet (25) for the liquid and/or within the profile assembly (2).

23. The basin (14) according to claim 18, comprising a discharging device (28) for filtering and discharging solids from the liquid, wherein the discharging device (28) is arranged adjacent to a bottom within the basin (14) or in a liquid outlet (25) of the basin (14) and wherein the discharging device (28) comprises a sheet filter component (29) through which the liquid can flow away, whereas the solids remain on a surface of the sheet filter component (29).

24. The basin (14) according to claim 23, wherein the sheet filter component (29) is mounted on a circulating roller conveyor (31) and can be moved in circulation by driving at least one roller of the roller conveyor (31), in order to discharge filtered-out solids in accordance with demand.

* * * * *